US012061039B1

(12) United States Patent
Fisher et al.

(10) Patent No.: US 12,061,039 B1
(45) Date of Patent: Aug. 13, 2024

(54) INDOOR/OUTDOOR COLD CABINET

(71) Applicant: Crescent Metal Products, Inc., Mentor, OH (US)

(72) Inventors: Chad Fisher, Cleveland, OH (US); Scott Petty, Painesville, OH (US); Brian Styers, Chardon, OH (US)

(73) Assignee: Crescent Metal Products, Inc., Mentor, OH (US)

( * ) Notice: Subject to any disclaimer, the term of this patent is extended or adjusted under 35 U.S.C. 154(b) by 659 days.

(21) Appl. No.: 17/147,107

(22) Filed: Jan. 12, 2021

Related U.S. Application Data

(60) Provisional application No. 62/966,251, filed on Jan. 27, 2020.

(51) Int. Cl.

| | |
|---|---|
| ***F25D 23/00*** | (2006.01) |
| ***F25B 13/00*** | (2006.01) |
| ***F25B 27/00*** | (2006.01) |
| ***F25D 11/00*** | (2006.01) |

(52) U.S. Cl.
CPC ..... *F25D 23/00* (2013.01); *F25B 13/00* (2013.01); *F25B 27/002* (2013.01); *F25D 11/00* (2013.01)

(58) Field of Classification Search
CPC .... F25D 11/003; F25D 23/00; F25D 2321/14; F25B 27/002
See application file for complete search history.

(56) References Cited

U.S. PATENT DOCUMENTS

| | | | | |
|---|---|---|---|---|
| 6,021,642 | A * | 2/2000 | Guinn | A45C 5/005 62/235.1 |
| 6,240,737 | B1 | 5/2001 | Albiez | |
| 6,931,881 | B1 * | 8/2005 | Movshovitz | F28F 17/005 62/93 |
| 2014/0216098 | A1 * | 8/2014 | Heinrich | F25D 29/003 62/448 |
| 2018/0320948 | A1 * | 11/2018 | Lundqvist | F25D 11/00 |
| 2019/0003757 | A1 * | 1/2019 | Miros | G06Q 10/0832 |

OTHER PUBLICATIONS

Acopower, "30/40/50L Rechargeable SolarFridge Freezer", User Manual of LiONCooler X30A/40A/50A, retrieved from https://support.acopower.com/kb/solar-freezer-lioncooler/lioncooler-x40a, available as of Jan. 15, 2020.

* cited by examiner

*Primary Examiner* — Joseph F Trpisovsky
(74) *Attorney, Agent, or Firm* — Renner, Otto, Boisselle & Sklar, LLP

(57) ABSTRACT

An indoor/outdoor cooling cabinet includes an internal cavity that may be maintained at a desired temperature by a cooling system that is powered by a DC power system having at least one onboard battery for facilitating use of the cabinet outdoors where an external power supply is not readily available. The cooling cabinet also includes an AC power system that is connectable to an external AC power source for replenishing the power stored in the at least one battery of the DC power system, which facilitates the use of the cabinet indoors.

19 Claims, 6 Drawing Sheets

INDOOR/OUTDOOR COLD CABINET

RELATED APPLICATIONS

This application claims the benefit of U.S. Provisional Application No. 62/966,251 filed Jan. 27, 2020, which is hereby incorporated herein by reference in its entirety.

FIELD OF INVENTION

The present invention relates generally to cold cabinets, and more particularly, to a hybrid indoor/outdoor cold cabinet.

BACKGROUND

In certain industries, cooling containers are commonly used for maintaining perishables at desired temperatures for periods of time. For example, cooling containers may be used at vending stands to maintain perishable foods in a predetermined temperature range prior to cooking. Such cooling containers may be used as mobile units for maintaining the desired temperature range during transport of the perishables to the point of use.

SUMMARY OF INVENTION

An aspect of the present invention provides an indoor/outdoor cooling cabinet having one or more advantages for enhancing the mobility and usability of the cooling cabinet between indoor and outdoor use.

According to an aspect of the invention, an indoor/outdoor cooling cabinet includes: a mobile housing having an internal cavity and an opening at a front side thereof; a door coupled to the mobile housing for closing the opening and for allowing access to the internal cavity; a cooling system configured to cool the internal cavity; a DC power system configured to power the cooling system when in a first operational state; and an AC power system configured to supply power to the DC power system for powering the cooling system when in a second operational state.

According to another aspect of the invention, an indoor/outdoor cooling cabinet includes: a mobile housing having a plurality of wheels for enabling transportation of the mobile indoor/outdoor cooling cabinet between an indoor location and an outdoor location, the mobile housing having insulated walls that define an internal cavity, and the mobile housing having an opening at a front side thereof; laterally spaced apart pairs of supports within the internal cavity for supporting shelves and/or trays, wherein the laterally spaced apart pairs of supports are arranged vertically spaced apart from each other in the internal cavity; an insulated door coupled to the mobile housing for closing the opening and for allowing access to the internal cavity; a cooling system configured to cool the internal cavity; a DC power system having at least one battery configured to supply direct current for powering the cooling system; and an AC power system configured to supply alternating current to replenish power in the at least one battery when connected to an external AC power source.

The ability to provide power with the DC power system and replenish such power with the AC power system provides one or more advantages for enhancing the mobility and usability of the cooling cabinet between indoor and outdoor use.

The cooling system may be a vapor-compression refrigerant system, and the components of the cooling system may be strategically located on the cabinet to provide one or more advantages, such as noise reduction and enhanced cooling effects.

The following description and the annexed drawings set forth certain illustrative embodiments of the invention. These embodiments are indicative, however, of but a few of the various ways in which the principles of the invention may be employed. Other objects, advantages and novel features according to aspects of the invention will become apparent from the following detailed description when considered in conjunction with the drawings.

BRIEF DESCRIPTION OF THE DRAWINGS

The annexed drawings, which are not necessarily to scale, show various aspects of the invention.

FIGS. 10-13 show various exemplary states of operation of the exemplary cooling system.

DETAILED DESCRIPTION

Figure 1:
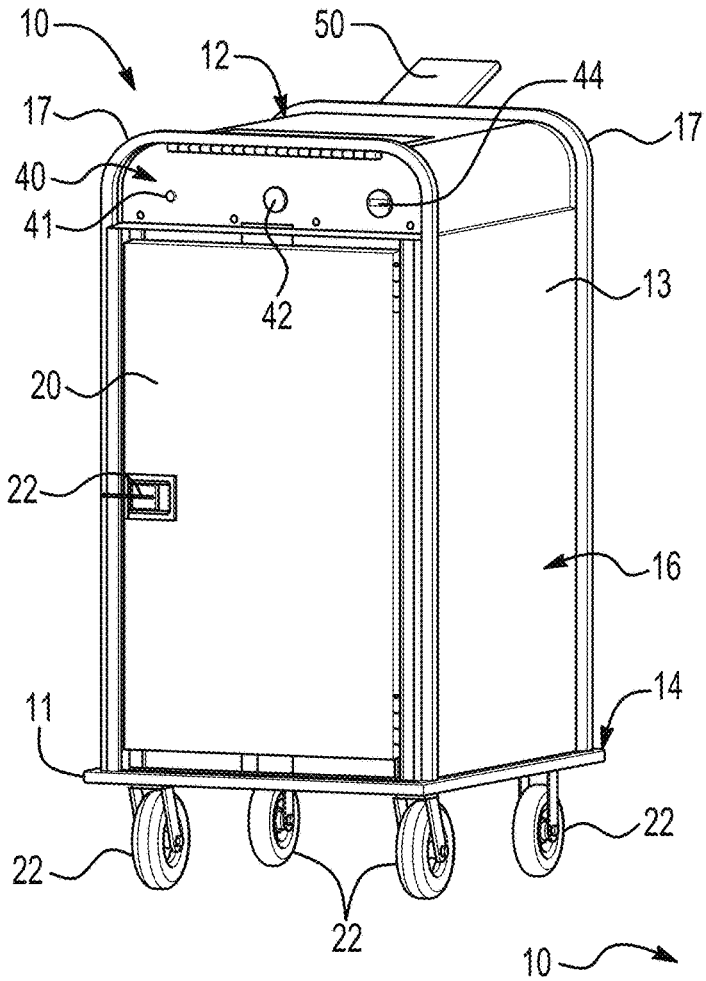
FIG. 1 is a front, side perspective view of an exemplary indoor/outdoor cooling cabinet according to an embodiment of the invention.

Referring now to the drawings in detail, and initially to FIG. 1, illustrated is an exemplary indoor/outdoor cold cabinet 10 having a cooling system that can be powered by a DC power system that receives power from a DC power source (such as via one or more onboard batteries), and which also has an AC power system that can be connected to an AC power source (such as via an indoor wall outlet or external generator) for supplying power to the DC power system (such as to charge the one or more batteries).

The cabinet includes a housing 12 having a base 14 and a body 16, which may be composed of one or more parts. The housing 12 may be reinforced by a frame, such as an internal stainless-steel frame, and may be made of any suitable material or combination of materials. The housing may include a perimeter bumper 11, which may be formed around the base for example, that helps prevent damage to the cabinet when it comes in contact with walls, doorframes, etc. A handle 17 may be provided at a top portion of the housing for a user to hold onto to push/pull the cabinet. A door 20 is provided for opening or closing an opening in the front of the housing 12 for allowing access to an internal cooling cavity 18 of the cabinet (shown in FIG. 2).

The housing 12 and the door 20 may be insulated to maintain the desired temperature range inside of the cavity 18 and/or prevent temperature gain due to higher ambient temperatures when the cabinet 10 is in use. The housing 12 may include an outer housing portion 13, which forms an outer surface of the housing, and an inner housing portion 15, which forms an inner surface of the interior cavity 18. The outer housing portion 13 may be made of any suitable material, such as powder-coated aluminum. The inner housing portion 15 may be made of any suitable material, such as stainless steel. The outer and/or inner housing portions 13, 15 may be formed by one or more parts that are coupled together; or the outer and/or inner housing portions 13, 15 may be formed as unitary parts. In the illustrated embodiment, for example, the inner housing portion 15 is formed by multiple parts, and the outer housing portion 13 is formed by a single U-shaped shell. An insulation gap may be formed between the outer housing portion 13 and the inner housing portion 15, in which the insulation gap may be filled with an insulation material, such as fiberglass and/or foam. Alternatively or additionally, an inside of the outer housing portion 15 may have insulation attached. The door 20 may be made of stainless steel and include a gasket such as a magnetic santoprene. The housing 12 and door 20 may be coated with a sun-reflective coating to shield the cabinet 10 from sun rays.

The door 20 is coupled to the housing 12 by any suitable means, such as by hinges. The door includes a handle 21 configured to latch to the housing by a suitable latch, such as a magnetic latch. In the illustrated embodiment the door is shown having the hinges attached to the right side, but it will be appreciated that the door may be available from the factory in the reverse position allowing the door to be hinged on the left side. The door 20 can be equipped with a any suitable lock to lock the cabinet, for example during transportation. The door 20 may also include a viewing window, which may be made of any suitable material, such as glass, acrylic glass, etc.

Attached to housing 12, for example at a bottom side of the base 14, is a plurality of wheels 22 that allow the cabinet to be moved easily, even when fully loaded and when tough outdoor conditions are experienced. A brake may be provided on one or more of the wheels so that the cabinet can be locked in place when being used. In the illustrated embodiment, the front two wheels 22 are all-terrain swivel casters with brakes, and the rear two wheels 22 are fixed to provide mobility when fully loaded, and stability during transport even in tough outdoor conditions.

Figure 2:
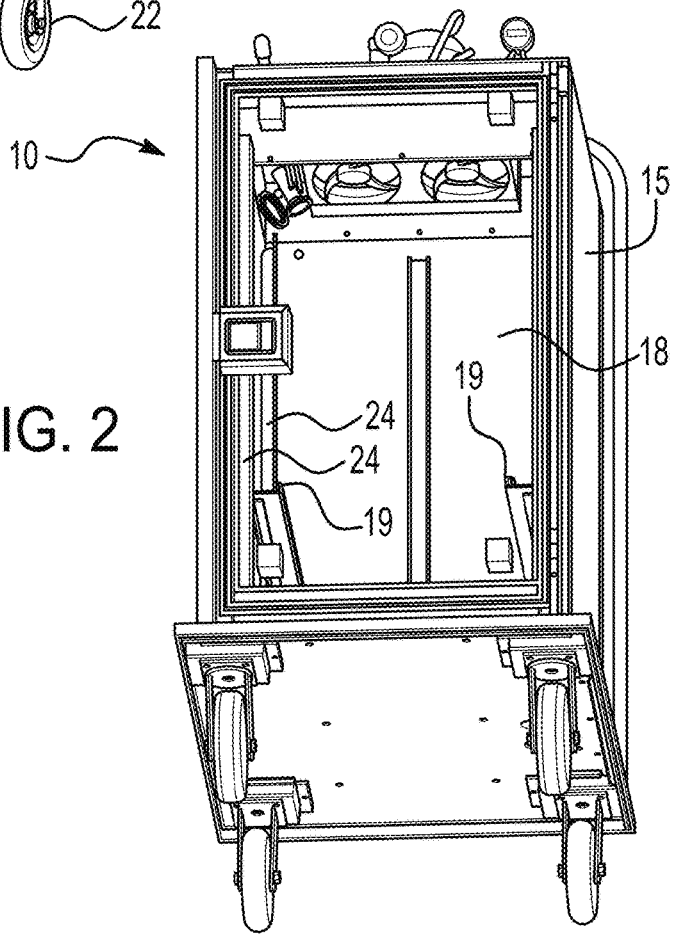
FIG. 2 is a bottom, front perspective view of the cooling cabinet with an outer portion of the housing removed and the front door shown in transparent view for showing an internal cavity of the cabinet.

Referring to FIG. 2, the cabinet 10 is shown with the front door 20 in transparent view. As shown, the housing 12 defines the internal cavity 18 for storing items to be cooled or maintain cold. The cavity 18 is accessible by the door 20 that closes an opening in the front of the housing 12. As shown, the cabinet 10 includes laterally spaced apart pairs of supports 19, such as angles, within the internal cavity 18 for supporting shelves and/or trays. In the illustrated embodiment, the supports 19 are arranged vertically spaced apart from each other in the internal cavity 18. The supports 19 on each side can be vertically adjusted so that the shelves and/or trays can be configured in any suitable manner. The supports 19 and shelves/trays are removable to allow the cavity to be cleaned. The inner surface of the cavity 18 may be made of any suitable material, such as stainless steel, and may include smooth interior coved corners to prevent buildup, such as by food particles and grease.

Figure 3:
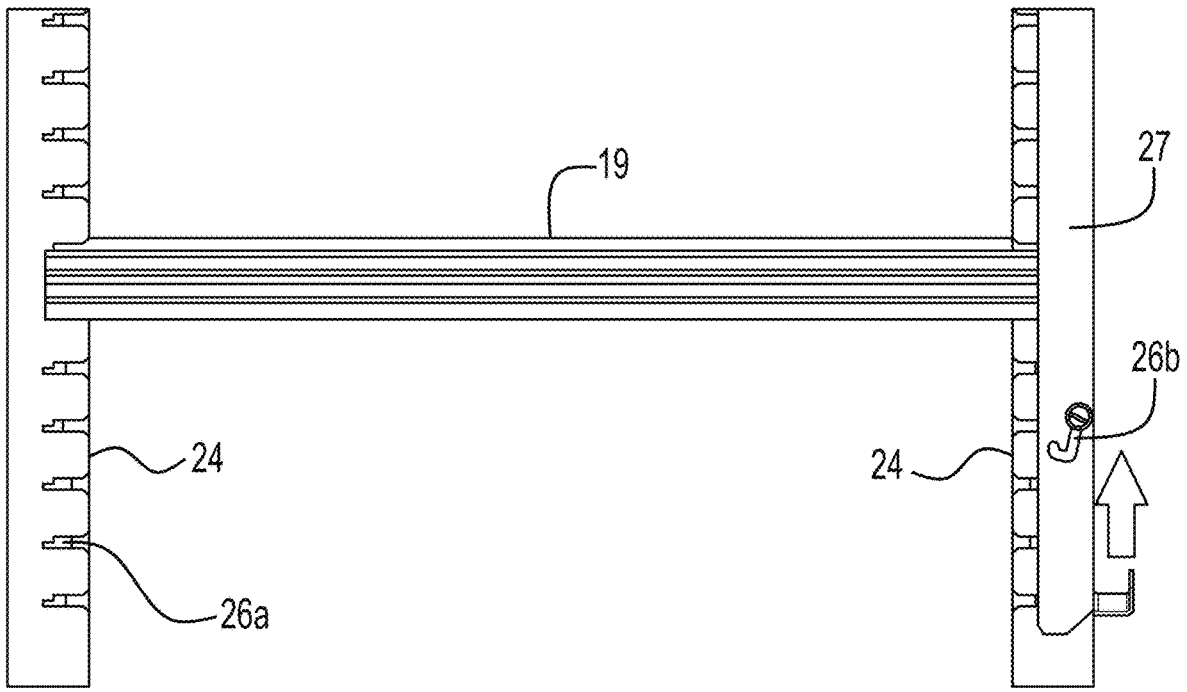
FIG. 3 is a side view of an exemplary locking support mounted on lift-off posts of the cabinet for supporting trays and/or shelves inside of the internal cavity.
Figure 4:
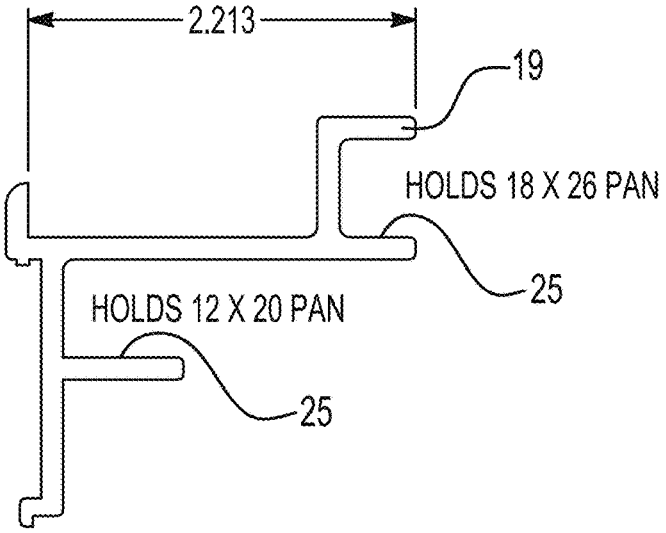
FIG. 4 is a side view of an exemplary support of the cabinet for supporting trays and/or shelves.

Referring to FIGS. 3 and 4, the exemplary supports 19 are shown in further detail. As shown in FIG. 3, the supports 19 may be formed as angles or slides that are mounted on lift-off posts 24 inside of the cavity 18 (also shown in FIG. 2). In the embodiment illustrated in FIG. 2, the cavity 18 includes four lift-off posts 24 that are laterally spaced apart from each other in a width direction, and which are spaced apart from each other in the depth direction. Each of the supports 19 spans the lift-off posts in the depth direction. The supports 19 may be made of any suitable material, such as aluminum or stainless steel, and may be plated, such as with chrome-plating. The supports 19 may be spaced on 3-inch centers, and may be adjustable on 1.5-inch centers, for example. Referring to FIG. 4, the supports 19 may be configured to hold different sized pans or trays, such as by having respective slots or grooves 25 at different spaced apart locations. In exemplary embodiments, the supports 19 are lockable with the lift-off posts 24. For example, as shown in FIG. 3, the vertical lift off post 24 has a slot **26*a* that is horizontal and has a certain height until a certain point, where it has a smaller height. In addition, a locking piece 27 is provided such that when that locking piece 27 is lifted, it moves on the angled slot 26*b* on its mounting point, moving the entire locking piece 27 to the right. At this point, support 19 can move forward and be released. When locking piece 27 is lowered again, it moves to the left and pushes support 19 into the smaller height of horizontal slot 26*a***, thereby preventing it from being lifted out.

Figure 5:
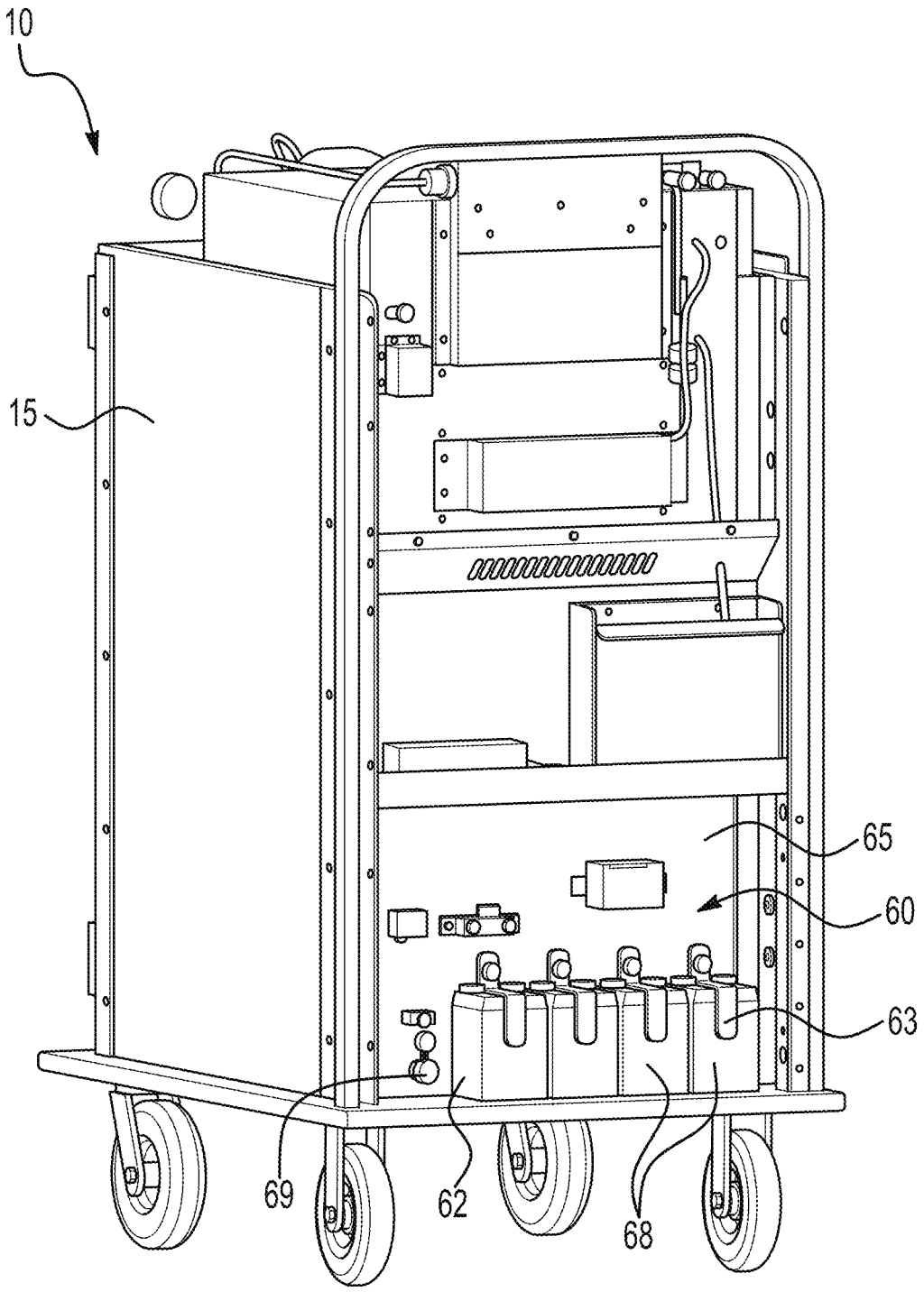
FIG. 5 is a rear, side perspective view of the cooling cabinet with the outer portion of the housing removed and with one or more rear panels removed for showing a storage well for an exemplary battery pack of the cooling cabinet.

Referring to FIG. 5, the back of the cabinet 10 is shown with the outer housing portion 13 of the housing removed, and with one or more panels of the back removed. As discussed below, the indoor/outdoor cold cabinet 10 includes a cooling system 80 that can be powered by a DC power system 72 that receives power from a DC power source (such as via one or more onboard batteries), and which also has an AC power system 70 that can be connected to an AC power source (such as via an indoor outlet or external generator) for supplying power to the DC power system 72 (such as to charge the power of the one or more batteries). The indoor/outdoor cabinet 10 thus facilitates transportation and use between an indoor location and an outdoor location by enabling powering of the cooling system 80 with the DC power system 72 when the cabinet 10 is being used in a remote location, such as outdoors for example, where the use of an external power source may be limited or undesirable; and which enables the DC power system 72 to receive power and/or be recharged from the AC power system 70 when used indoors, for example, such as when plugged into an inside wall outlet.

In exemplary embodiments, the AC power source is provided by any suitable AC power source, and more particularly an external AC power source, such as by connecting an electrical cord from the cabinet 10 to a wall outlet or an external generator. The AC power source may be a standard 120 VAC source, for example, although any suitable voltage and/or current of the AC power source may be provided. In exemplary embodiments, the DC power source is provided by one or more batteries 68 (collectively or singularly referred to as a battery pack 68). The battery pack 68 may provide any suitable voltage and/or current, such as a 12 VDC power source, for example. The battery pack 68 may be a standard battery pack 68 that may provide about 3 to 6 hours of operating time, for example; or the battery pack 68 may be a high-capacity battery pack that may provide upwards of 6 to 8 hours of operating time, for example. The battery pack 68 may be replaceable and/or rechargeable. The battery pack 68 may be recharged by the AC power source and/or any other suitable recharging source. In exemplary embodiments, the battery pack 68 may include high-capacity $LiFePO_4$ rechargeable batter(ies). The DC power system can be integrated into the charging system of vehicle during transport, or can be used to power external devices.

As shown, the battery pack 68 may be an onboard battery pack that is stored in at least one storage well 62 of the housing 12. The storage well 62 facilitates transportation of the battery pack 68 along with the mobile housing 12, such as when the cabinet 10 is transported outdoors and used in the DC power mode. In the illustrated embodiment, the battery pack 68 is secured in the storage well 62 with one or more fasteners 63, such as flexible tabs. As shown, the storage well 62 and battery pack 68 may be located in a lower recessed area 60 of the housing 12 having a back wall 65 that separates the recessed area 60 from the cavity 18. Also as shown, the recessed area 60 may include an electrical connector 69, such as a female receptacle, that enables an electrical cord with a corresponding male connector to be plugged in for providing electrical connection to the external AC power source (e.g., wall outlet). Alternatively, the electrical cord may be hardwired to the cabinet 10. The recessed area 60 may be closed by a panel (not shown) that may be secured to the housing 12 by a suitable fastener. The panel may be removed to allow access to the recessed area 60 and specifically to the battery pack 68. In exemplary embodiments, the panel may include one or more openings that allow access to the battery pack 68, so the battery pack 68 can be inserted or removed without having to remove the panel. The openings in the panel also may enable access to the electrical connector 69.

In exemplary embodiments, the cabinet 10 also includes a solar panel 50 (shown in FIG. 1), which may be provided as part of the DC power system to charge the battery pack 68, power the controls of the cabinet 10, and/or or other components of the cabinet, either directly or indirectly through the battery pack 68. The solar panel 50 can be conventional in the art and its manufacture and fabrication is well known. The solar panel can be attached to the cabinet 10 in any suitable manner and at any suitable location. In exemplary embodiments, the solar panel 50 is attached by a hinge, or plurality of hinges, to allow the solar panel 50 to be adjusted to receive an optimum amount of sunlight. The hinge also may enable the solar panel 50 to be moved to a stored position in a recessed area (not shown) in the back of the cabinet 10 to prevent the solar panel from being damaged during transportation or when stored and to allow the cabinet to be stored in smaller areas.

Referring to FIGS. 10-13, various exemplary states of operating the cooling system 80 of the cooling cabinet 10 with the DC power system 72 and the AC power system 70 are shown. Generally, in exemplary embodiments the cooling system 80 and/or other electrical components of the cabinet 10 are powered by the DC power system 72 via the battery pack 68 at all times when in use (powered on), and the AC power system 70 and/or solar power from the solar panel 50 are used when available to supply power to the DC power system 72 to recharge the battery pack 68.

For example, as shown in FIG. 10, when the cooling cabinet 10 is not receiving power from an external power source, such as an AC source (e.g., outlet or generator) or solar power, then the controller 74 is configured to run the cooling system 80 and other electronics with the DC power system 72 via the battery pack 68.

FIG. 11 shows an exemplary operating state when solar power 77 is provided without additional AC power. As shown, if the solar panel 50 is plugged in and adequate light is reaching its surface, then an onboard solar charger 75 will send DC current into the battery pack 68 to provide it with power and/or recharge it. The controller 74 will run the cooling system 80 and other electronics with the DC power system 72 via the available (replenished) power in the battery pack 68.

FIG. 12 shows an exemplary operating state when external AC power 78 (such as wall outlet) is provided without additional solar power. As shown, the AC power system 70 includes a battery charger 76 (e.g., AC voltage input, 14.6 VDC max output), which may be an external battery charger that is not mounted onto the cabinet 10. In this manner, the onboard electrical devices of the cabinet 10 may constitute the DC side of the system 72 which may interface with the off-board electrical components of the AC power system 70 of the cabinet 10. It is understood, however, that portions of the AC system 70 including the battery charger 76 and/or other components thereof could be mounted onboard the cabinet 10. As shown in the exemplary operating state, when the battery charger 76 is plugged in to the cabinet 10 (DC side) and the external AC source 78 (AC side), the charger 76 will send DC current into the battery pack 68 of the DC system 70, thereby supplying the battery pack 68 with power and charging it. The controller 74 will run the cooling system 80 and other electronics with the DC power system 72 via the available (replenished) power in the battery pack 68.

FIG. 13 shows an exemplary operating state when both AC power and solar power are provided. As shown, solar power 77 (e.g., sunlight) is provided to the solar panel 50, and the solar charger 75 sends DC current into the battery pack 68. Simultaneously, AC power 78 is provided and the battery charger 76 sends DC current to the battery pack 68. The controller 74 will run the cooling system 80 and other electronics with the DC power system 72 via the available (replenished) power in the battery pack 68.

It is understood that although the DC power system 72 is shown always controlling the cooling system 80 and other electrical devices of the cabinet 10, in alternative embodiments it is possible that the DC power system 72 could be configured to power the cooling system 80 and/or other electronics in a first operational mode (e.g., a DC power mode), such as when not receiving external power from an AC outlet and/or solar panel; and the AC power system 70 could be configured to power the cooling system 80 and/or other electronics independent of the DC power system 72 in a second operational mode (e.g., an AC power mode), such as when receiving external AC power when plugged in to a wall outlet or generator, for example.

Referring back to FIG. 1, a control panel 40 is provided on the front of the cabinet 10. The control panel 40 is shown above the door 20 but may be included at any suitable location on the cabinet 10. The control panel 40 may include any suitable control device(s) for operating the cabinet 10. For example, the control panel 40 may include an on/off switch 41 for turning the cabinet on or off. The on/off switch 41 may light up to indicate that the cooling system of the cabinet 10 is running. The control panel 40 also may include a thermometer 42, such as a digital thermometer, for displaying the temperature inside of the internal cavity 18. The thermometer 42 may be in electrical communication with a sensor, such as a thermocouple or thermistor, that is in thermal communication with the cavity 18 for sensing the temperature thereof. The control panel 40 may include a thermostat (hidden from view) for controlling the temperature inside of the internal cavity 18. The thermostat may provide a fixed temperature inside of the cavity 18, such as 38° F. for example. Alternatively, the thermostat may be configured to permit adjusting the temperature inside the cabinet 10. The control panel 40 may include a battery indicator 44 that displays the charge of the battery pack 68, which may include an amp-hour meter, an icon showing the charge, and/or the estimated number of hours available for running on battery power. In addition, one or more controls, such as the electronic controller 74 (illustrated schematically in FIGS. 10-13), may be located at other locations on the cabinet 10, and may be operably coupled to the control panel, thermostat, thermometer, etc. In the illustrated embodiment, the controller 74 may be built into the compressor driver which is mounted on the compressor 82 (described below). A user input on the control panel 40 to set a desired temperature of the cavity 18 may be communicated to the controller 74, which may make a determination of the current temperature via the thermometer or other sensor associated with the controller 74, and may increase or decrease the temperature via the thermostat which controls operation of the cooling system 80 to achieve the desired setpoint temperature.

In exemplary embodiments, the control panel 40 may include a touch screen and display that may replace one or more of the above components, such as by displaying the power source being used, temperature inside the cabinet, time of day, etc. Additionally or alternatively, the cabinet 10 may include a communications module, such as a receiver or transceiver (e.g., Bluetooth or near field), for communicating information about the temperature and/or control of the cabinet 10 to an external device, such as a smartphone or the like. As discussed above, in exemplary embodiments the control panel 40 and/or other electrical components (e.g., controller 74, etc.) are powered from the same power source via the same system (e.g., DC power system) that powers the cooling system 80 based upon the operating state of the cabinet 10.

Figure 6:
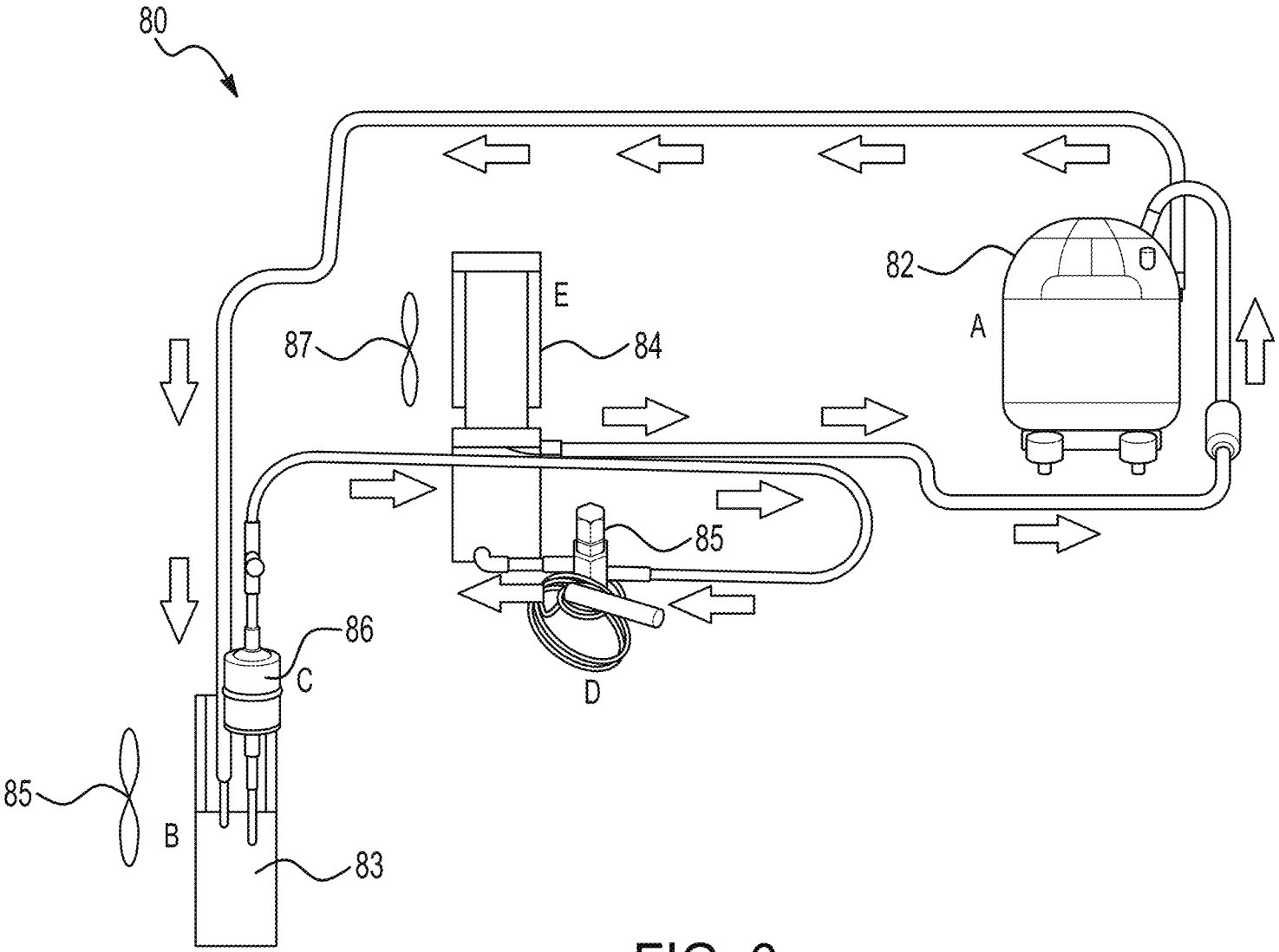
FIG. 6 is a schematic diagram of an exemplary cooling system of the cooling cabinet.

Referring to FIGS. 6, an exemplary cooling system 80 of the indoor/outdoor cooling cabinet 10 is shown. The cooling system 80 may be any suitable cooling system, such as a refrigerant cooling system, thermoelectric cooling system, or the like. In the illustrated embodiment, the cooling system 80 is a vapor-compression refrigerant cooling system 80 which operates in a manner well-known in the art. As shown, the refrigerant cooling system 80 includes a refrigerant circuit having a hermetic compressor 82, a condenser 83, an evaporator 84, and a thermal expansion valve 85. The refrigerant used in the refrigerant circuit may be any suitable refrigerant, such as R134a or R513a refrigerant. Generally, the refrigerant cooling system 80 operates by compressing refrigerant vapor by the compressor 82, in which the compressed refrigerant then goes through the condenser 83 to cool and condense into a liquid. A tangential condenser fan 85 may be used to force air across the condenser 83 coils to aid in the cooling of the refrigerant. The liquid refrigerant then may pass through a filter 86 and into the thermal expansion valve 85 where it expands to create a cooling effect of the refrigerant. The expanded refrigerant then passes to the evaporator 84. Heat is absorbed from the internal cooling cavity 18 into the super cooled refrigerant inside the evaporator 84 coils which evaporates the refrigerant. An evaporator fan 87 may be used to help aid in heat absorption by the evaporator 84. The compressor 82, evaporator fan 87 and/or condenser fan 85 may operate on DC power, such as 12 VDC power provided directly by the battery pack 68 in the manner described above.

Figure 7:
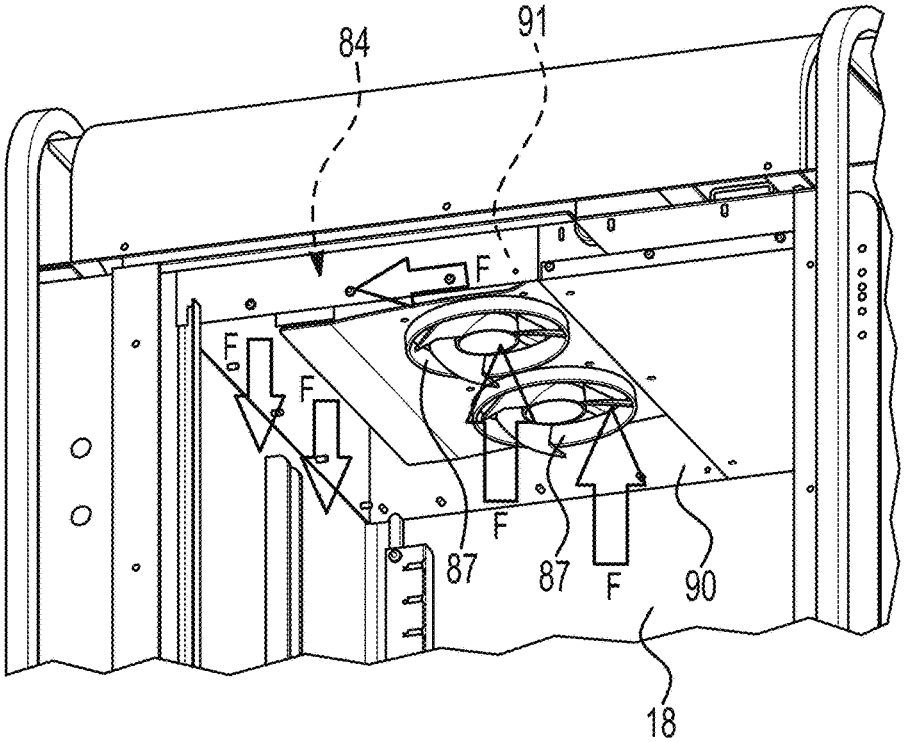
FIG. 7 is an enlarged bottom, side perspective view of the cooling cabinet with a side of the housing shown in transparent view for showing the direction of airflow via an evaporator in the cooling system.
Figure 8:
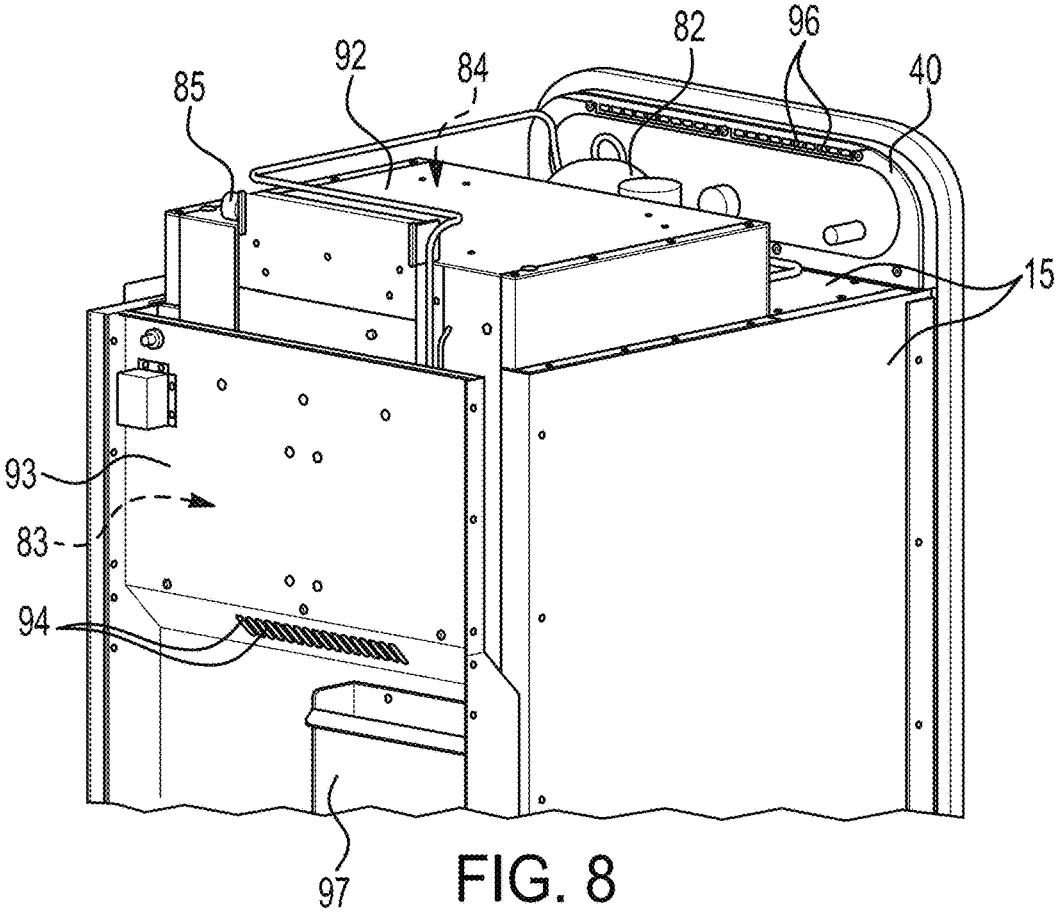
FIG. 8 is an enlarged top, rear perspective view of the cooling cabinet with the outer portion of the housing removed for showing a condensing unit of the cooling system.
Figure 9:
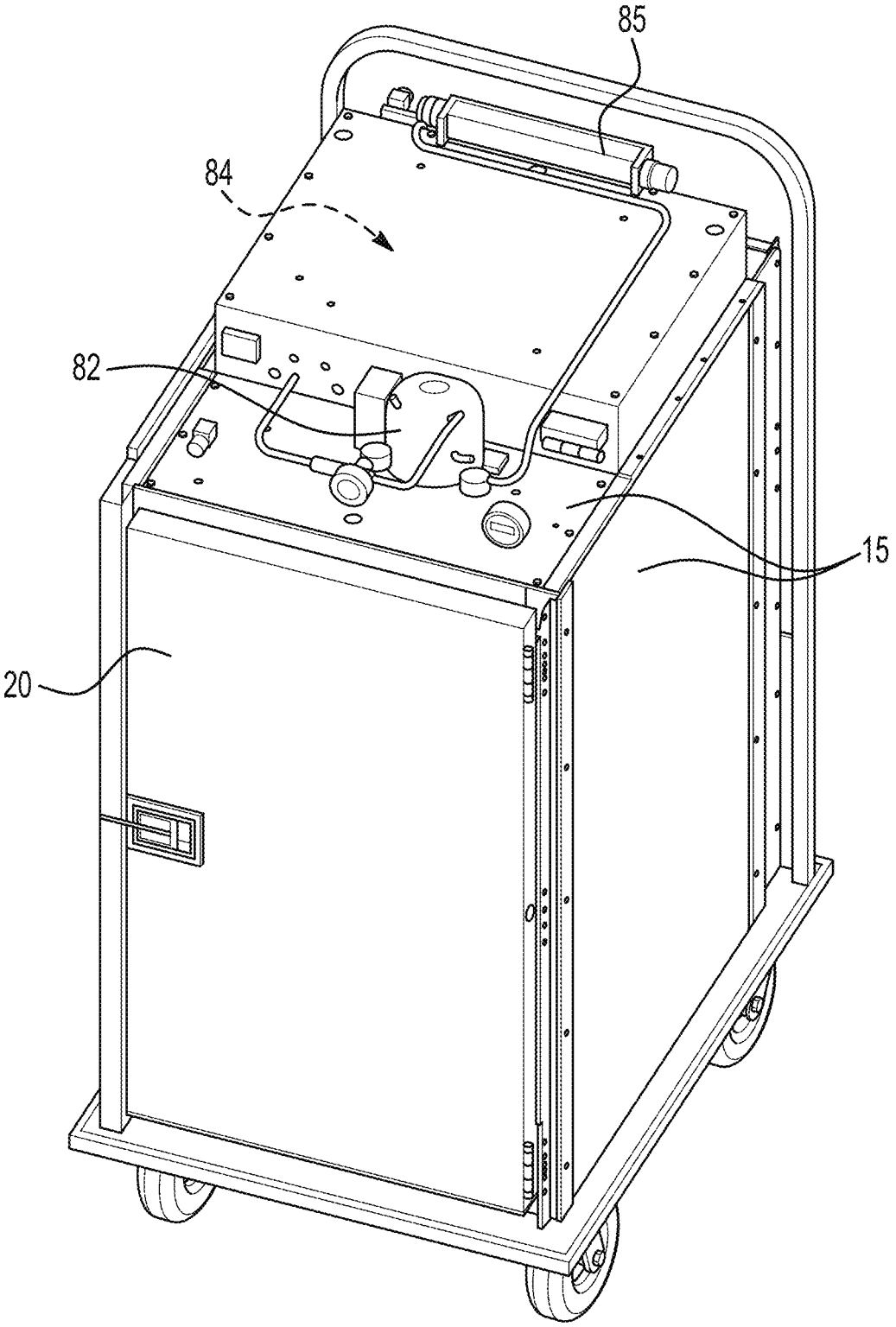
FIG. 9 is a top, front perspective view of the cooling cabinet with the outer portion of the housing removed for showing portions of the cooling system.

Referring to FIGS. 7-9, the arrangement of the components of the refrigerant cooling system 80 in the cooling cabinet 10 are shown in further detail. As shown in FIG. 7, for example, the evaporator fan(s) 87 are disposed in opening(s) in an upper internal panel 90 (shown in partially transparent view) inside of the cavity 18. As shown with the directional airflow lines, F, the evaporator fan(s) 87 draw air from the internal cavity 18 and push the air through an air tunnel 91 to the evaporator 84. Referring also to FIG. 8, the evaporator 84 is disposed in a partially isolated upper portion of the cabinet 10, such as within an evaporator casing portion 92, which may be formed as an upper extent of the internal cavity 18. As shown, the casing portion 92 is disposed between the outer housing portion 13 and the inner housing portion 15. The evaporator casing portion 92 may be partially isolated by the panel 90 having opening(s) for receiving the air flow from the internal cavity 18, thus enabling the air from the cavity 18 to pass over the evaporator coils and absorb heat into the refrigerant passing therethrough. The airflow passing over the evaporator 84, which is now cooler due to the heat absorption, is then passed along the back wall of the internal cavity 18 to provide a tight temperature stratification inside of the cavity 18.

As shown in FIGS. 8 and 9, the compressor 82 is disposed in a space between the outer housing portion 13 and the inner housing portion 15 behind the control panel 40. Also provided between the outer housing portion 13 and inner housing portion 15 is the tangential condenser fan 85. Such isolation of the compressor 82 and/or fan 85 may minimize the amount of noise emitted by the compressor external to the cabinet 10. The condenser 83 is provided at the rear of the cabinet 10 behind a rear condenser panel 93. The condenser fan 85 draws in air, such as within the space between outer and inner housing portions 13, 15, and forces the air downward across the condenser 83 coils. The air flowing across the condenser 83 is then vented externally of the cabinet 10 such as via one or more openings 94 in the rear condenser panel 93. As shown, the refrigerant conduits 95 also are provided between the outer housing 13 and inner housing 15, which may thus provide the indoor/outdoor cooling cabinet with a self-contained structure that enhances its ruggedness and durability.

In exemplary embodiments, the arrangement of the components of the cooling system 80 also may provide an enhanced cooling effect for the electronic components of the system. For example, the tangential condenser fan 85 may be configured to draw air from openings 96 in the front control panel 40 and through the space between the outer and inner housing portions 13, 15 to cool the control circuitry and other electronic components. This air is pulled into the tangential fan 85 and turns 90-degrees to be forced downward across the condenser 83 and exit via the openings 94 in the rear condenser panel 93. A condensate pan 97 for collecting condensate from the evaporator 84 may be provided below the rear panel 93 that contains the condenser 83. The hot air exiting the openings 94 in the rear panel 93 may blow across or into the condensate pan 97, thereby assisting in evaporation of the condensate liquid.

An exemplary indoor/outdoor cooling cabinet 10 has been described herein. As described above, the indoor/outdoor cooling cabinet 10 includes an internal cavity 18 that may be maintained at a desired temperature by a cooling system 80 that is powered by a DC power system 72 having at least one onboard battery 68 for facilitating use of the cabinet 10 outdoors where an external power supply is not readily available, or is undesirable (e.g., with an external generator). The cooling cabinet 10 also includes an AC power system that is connectable to an external AC power source for replenishing the power stored in the at least one battery of the DC power system, which facilitates the use of the cabinet indoors.

Embodiments of the subject matter described in this disclosure can be implemented in combination with digital electronic circuitry, controllers, processors, computer software, firmware, and/or hardware. For example, embodiments may be implemented in an indoor/outdoor cooling cabinet and/or cooling system that uses one or more modules of computer program with instructions encoded on a non-transitory computer-readable medium for execution by, or to control the operation of, data processing apparatus. The operations may include physical manipulations of physical quantities. Usually, though not necessarily, the physical quantities take the form of electrical or magnetic signals capable of being stored, transferred, combined, compared, and otherwise manipulated in a logic and the like.

The controller may include, in addition to hardware, code that creates an execution environment for the computer program in question. The computer program (also referred to as software or code), may be deployed in any form, including as a stand-alone program or as a module, component, subroutine, or other unit suitable for use in a computing environment. The computer program may be deployed to be executed on one computer or on multiple computers that are located at one site or distributed across multiple sites and interconnected by a communication network. The processor may include all apparatus, devices, and machines suitable for the execution of a computer program, which may include, by way of example, both general and special purpose microprocessors, and any one or more processors of any kind of digital computer. Generally, the processor will receive instructions and data from a read-only memory or a random-access memory or both. The computer may include, or be operatively coupled to receive data from or transfer data to, or both, one or more mass storage devices for storing data. Devices suitable for storing computer program instructions and data include all forms of non-volatile memory, media and memory devices, including by way of example semiconductor memory devices. The processor and the memory can be supplemented by, or incorporated in, special purpose logic circuitry.

As used herein, an "operable connection," or a connection by which entities are "operably connected," is one in which the entities are connected in such a way that the entities may perform as intended. An operable connection may be a direct connection or an indirect connection in which an intermediate entity or entities cooperate or otherwise are part of the connection or are in between the operably connected entities. An operable connection or coupling may include the entities being integral and unitary with each other.

An "operable connection," or a connection by which entities are "operably connected," also may be one in which signals, physical communications, or logical communications may be sent or received. Typically, an operable connection includes a physical interface, an electrical interface, or a data interface, but it is to be noted that an operable connection may include differing combinations of these or other types of connections sufficient to allow operable control. For example, two entities can be operably connected by being able to communicate signals to each other directly or through one or more intermediate entities like a processor, operating system, a logic, software, or other entity. Logical or physical communication channels can be used to create an operable connection.

As used herein, the phrase "and/or" should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified unless clearly indicated to the contrary. Thus, as a non-limiting example, a reference to "A and/or B," when used in conjunction with open-ended language such as "comprising" can refer, in one embodiment, to A without B (optionally including elements other than B); in another embodiment, to B without A (optionally including elements other than A); in yet another embodiment, to both A and B (optionally including other elements); etc.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A mobile indoor/outdoor cooling cabinet, comprising:

a mobile housing having an internal cavity and an opening at a front side thereof;

a door coupled to the mobile housing for closing the opening and for allowing access to the internal cavity;

a cooling system configured to cool the internal cavity by generating refrigerated air;

a DC power system having at least one battery configured to power the cooling system when in a first operational state;

an AC power system configured to supply power to the DC power system for powering the cooling system when in a second operational state; and a controller that is configured to always run the cooling system to cool the internal cavity by generating refrigerated air with available power from the at least one battery when the cabinet is operating in both the first operational state and the second operational state.

2. A mobile indoor/outdoor cooling cabinet, comprising:

a mobile housing having a plurality of wheels for enabling transportation of the mobile indoor/outdoor cooling cabinet between an indoor location and an outdoor location, the mobile housing having insulated walls that define an internal cavity, and the mobile housing having an opening at a front side thereof;

laterally spaced apart pairs of supports within the internal cavity for supporting shelves and/or trays, wherein the laterally spaced apart pairs of supports are arranged vertically spaced apart from each other in the internal cavity;

an insulated door coupled to the mobile housing for closing the opening and for allowing access to the internal cavity;

a cooling system configured to cool the internal cavity by generating refrigerated air;

a DC power system having at least one battery configured to supply direct current for powering the cooling system when in a first operational state;

an AC power system configured to supply alternating current to replenish power in the at least one battery when connected to an external AC power source when in a second operational state; and a controller that is configured to always run the cooling system to cool the internal cavity by generating refrigerated air with available power from the at least one battery when the cabinet is operating in both the first operational state and the second operational state.

3. The mobile indoor/outdoor cooling cabinet according to claim 2, wherein the AC power system includes a charger that is connectable to the external AC power source, and wherein the charger is configured to provide DC current to the DC power system to replenish power in the at least one battery.

4. The mobile indoor/outdoor cooling cabinet according to claim 3, wherein the charger of the AC power system is connectable to the AC power source via a wired electrical connection.

5. The mobile indoor/outdoor cooling cabinet according to claim 3, wherein the charger of the AC power system is external to the cabinet, and is operably connected to the DC power system via an electrical connector on the cabinet.

6. The mobile indoor/outdoor cooling cabinet according to claim 2, wherein the DC power system includes a DC power source.

7. The mobile indoor/outdoor cooling cabinet according to claim 6, wherein the DC power source includes the at least one battery.

8. The mobile indoor/outdoor cooling cabinet according to claim 2, wherein (i) when the AC power system is operably coupled to the AC power source, and (ii) when the at least one battery has a charge that is below a threshold level, then the at least one battery is charged by the AC power source via a charger.

9. The mobile indoor/outdoor cooling cabinet according to claim 2, wherein the cabinet includes a solar panel operably coupled to the DC power system, the solar panel being configured to receive solar power for charging the at least one battery.

10. The mobile indoor/outdoor cooling cabinet according to claim 2, wherein the cooling system includes a vapor-compression refrigerant circuit, the vapor-compression refrigerant circuit comprising a compressor, a condenser, and an evaporator.

11. The mobile indoor/outdoor cooling cabinet according to claim 10, wherein the cooling system further includes an evaporator fan configured to pass air from the internal cavity of the cabinet into an airflow passage, then across the evaporator, and then back into the internal cavity.

12. The mobile indoor/outdoor cooling cabinet according to claim 10, wherein the evaporator is disposed above the internal cavity or in an upper portion of the internal cavity.

13. The mobile indoor/outdoor cooling cabinet according to claim 2, wherein the cooling system further includes a condenser fan disposed in a space between an inner portion and an outer portion of the housing.

14. The mobile indoor/outdoor cooling cabinet according to claim 13, wherein the condenser fan is configured to draw air into the space via one or more openings in a control panel of the cabinet.

15. The mobile indoor/outdoor cooling cabinet according to claim 13, wherein the space contains a compressor and/or one or more control devices of the cabinet, such as the controller, and wherein the condenser fan is configured to pass air across the space for facilitating cooling of the compressor and/or the one or more control devices.

16. The mobile indoor/outdoor cooling cabinet according to claim 15, wherein the space containing the condenser fan is located above the internal cavity of the cabinet.

17. The mobile indoor/outdoor cooling cabinet according to claim 10, further comprising a liquid condensate collector, the liquid condensate collector being located at a position relative to the condenser such that a condenser fan passing air across the condenser is then passed across the condensate collector for facilitating evaporation of the condensate liquid.

18. The mobile indoor/outdoor cooling cabinet according to claim 2, further comprising a communications module configured to communicating to an external electronic device for displaying battery information and/or temperature, and/or for controlling a temperature inside the internal cavity.

19. A mobile indoor/outdoor cooling cabinet, comprising:

a mobile housing having a plurality of wheels for enabling transportation of the mobile indoor/outdoor cooling cabinet between an indoor location and an outdoor location, the mobile housing having insulated walls that define an internal cavity, and the mobile housing having an opening at a front side thereof;

laterally spaced apart pairs of supports within the internal cavity for supporting shelves and/or trays, wherein the laterally spaced apart pairs of supports are arranged vertically spaced apart from each other in the internal cavity;

an insulated door coupled to the mobile housing for closing the opening and for allowing access to the internal cavity;

a cooling system configured to cool the internal cavity by generating refrigerated air;

a DC power system having at least one battery configured to supply direct current for powering the cooling system when in a first operational state;

a solar panel operably connected in the DC power system for supplying power to the at least one battery when receiving external solar power when in a second operational state; and a controller that is configured to always run the cooling system to cool the internal cavity by generating refrigerated air with available power from the at least one battery when the cabinet is operating in both the first operational state and the second operational state.

* * * * *